US012405063B2

(12) United States Patent
Wang et al.

(10) Patent No.: US 12,405,063 B2
(45) Date of Patent: Sep. 2, 2025

(54) HEAT EXCHANGER AND AIR CONDITIONING DEVICE

(71) Applicant: ZHEJIANG DUNAN ARTIFICIAL ENVIRONMENT CO., LTD., Shaoxing (CN)

(72) Inventors: Guanjun Wang, Shaoxing (CN); Zhaozhong Lan, Shaoxing (CN); Ergang Ding, Shaoxing (CN)

(73) Assignee: ZHEJIANG DUNAN ARTIFICIAL ENVIRONMENT CO., LTD., Shaoxing (CN)

( * ) Notice: Subject to any disclaimer, the term of this patent is extended or adjusted under 35 U.S.C. 154(b) by 197 days.

(21) Appl. No.: 18/230,902

(22) Filed: Aug. 7, 2023

(65) Prior Publication Data

US 2023/0384042 A1 Nov. 30, 2023

Related U.S. Application Data

(63) Continuation of application No. PCT/CN2022/071785, filed on Jan. 13, 2022.

(30) Foreign Application Priority Data

Feb. 7, 2021 (CN) ..... 202120350926.9

(51) Int. Cl.
*F28D 1/047* (2006.01)
*F28F 1/02* (2006.01)

(52) U.S. Cl.
CPC ..... *F28D 1/0476* (2013.01); *F28F 1/02* (2013.01); *F28F 2215/00* (2013.01); *F28F 2275/06* (2013.01)

(58) Field of Classification Search
CPC ..... F28D 1/0476
See application file for complete search history.

(56) References Cited

U.S. PATENT DOCUMENTS 6,178,766 B1 * 1/2001 Tong ..... F28D 1/0477 62/304

FOREIGN PATENT DOCUMENTS

| | | | |
|---|---|---|---|
| CN | 101846465 | A | 9/2010 |
| CN | 201652995 | U | 11/2010 |
| CN | 201697494 | U | 1/2011 |
| CN | 103196259 | A | 7/2013 |
| CN | 203132214 | U | 8/2013 |
| CN | 208588116 | U | 3/2019 |
| CN | 110686429 | A | 1/2020 |
| CN | 215063872 | U | 12/2021 |

(Continued)

OTHER PUBLICATIONS

International Search Report of PCT/CN2022/071785.

*Primary Examiner* — Eric S Ruppert

(57) ABSTRACT

A heat exchanger and an air conditioning device are provided. The heat exchanger includes a plurality of fins and a plurality of flat pipes arranged in parallel. Each of the plurality of flat pipes includes a first finned region, a second finned region, and a finless region. An end of the finless region connected to the first finned region is twisted and defined as a first torsion section, the other end of the finless region connected to the second finned region is twisted and defined as a second torsion section, and a portion of the finless region between the first torsion section and the second torsion section is defined as a connecting section.

9 Claims, 9 Drawing Sheets

(56) References Cited

FOREIGN PATENT DOCUMENTS

| | | | |
|---|---|---|---|
| CN | 215063873 | U | 12/2021 |
| JP | 08145580 | A | 6/1996 |
| WO | WO2005071340 | A1 | 8/2005 |

* cited by examiner

HEAT EXCHANGER AND AIR CONDITIONING DEVICE

CROSS-REFERENCE TO RELATED APPLICATIONS

This application is a continuation of international patent application No. PCT/CN2022/071785, filed on Jan. 13, 2022, which itself claims priority to Chinese patent application No. 202120350926.9, filed on Feb. 7, 2021, and titled "HEAT EXCHANGER AND AIR CONDITIONING DEVICE" in the China National Intellectual Property Administration, the content of which is hereby incorporated by reference in its entirety.

TECHNICAL FIELD

The present disclosure relates to the field of refrigeration technology, and in particular, to a heat exchanger and an air conditioning device.

BACKGROUND

In the field of refrigeration technology, a heat exchanger is an important component in four major refrigeration components, and plays a role of heat exchange with an outside environment. The heat exchanger typically includes a collecting pipe, a plurality of flat pipes connected to the collecting pipe, and a plurality of fins disposed between the adjacent two flat pipes. In a specific air conditioning device, the heat exchanger should be bent to meet a specific mounting requirement. Moreover, it is not necessary to provide the plurality of fins on a bent part of each of the plurality of flat pipes. Therefore, in the related art, each of the plurality of flat pipes includes a finned region and a finless region. Two finned regions are provided at two ends of each of the plurality of flat pipes, and the plurality of fins is disposed between two finned regions corresponding to adjacent two of the plurality of flat pipes. The finless region is provided at the middle of each of the plurality of flat pipes. However, in the related art, a length of the finless region of the heat exchanger may be too short, causing the heat exchanger to fracture after being bent. The length of the finless region of the heat exchanger may be too long, causing a problem of material waste.

SUMMARY

In view of above, it is necessary to provide a heat exchanger and an air conditioning device, so that the problems that the heat exchanger fractures after being bent caused by unduly short length of the finless region of the heat exchanger and material waste caused by unduly long length of the finless region of the heat exchanger in the related can be solved.

The present disclosure provides a heat exchanger. The heat exchanger includes a plurality of fins and a plurality of flat pipes arranged in parallel. Each of the plurality of flat pipes includes a first finned region, a second finned region, and a finless region. The first finned region is connected to the second finned region via the finless region. The plurality of fins are provided both between adjacent two first finned regions and between adjacent two second finned regions. An end of the finless region connected to the first finned region is twisted and defined as a first torsion section, and the other end of the finless region connected to the second finned region is twisted and defined as a second torsion section. A portion of the finless region between the first torsion section and the second torsion section is defined as a connecting section. Both the first torsion section and the second torsion section are twisted at a second angle along the same direction, so that each connecting section of the plurality of flat pipes is sequentially and partially stacked on an adjacent connecting section along the same direction. The second angle is defined as b. The connecting section is bent, so that the first finned region is capable of rotating at a first angle relative to the second finned region, and the first angle is defined as a. A length of the finless region is defined as L, a length of the first torsion section is the same as a length of the second torsion section, and both the length of the first torsion section and length of the second torsion section are defined as S, a length of the connecting section is defined as M, and a width of each of the plurality of flat pipes is defined as W. The length L of the finless region, the length S of the first torsion section and the length S of the second torsion section, the length M of the connecting section and the width W of each of the plurality of flat pipes satisfy following formulas: $L=2S+M$, $S \geq W(\pi/2+1)$, and the length M of the connecting section is greater than or equal to the width W of each of the plurality of flat pipes.

In an embodiment of the present disclosure, the second angle b is in a range of greater than or equal to 50 degrees and less than 90 degrees. When the second angle b is less than 90 degrees, it is conducive to stacking adjacent two of a plurality of connecting sections together. When the second angle b is greater than or equal to 50 degrees, it is conducive to bending the connecting section, so that the first angle a can be defined between the first finned region and the second finned region.

In an embodiment of the present disclosure, the first angle a is in a range of greater than 0 and less than or equal to 180 degrees. In this way, the connecting section of the heat exchanger can be bent according to actual needs, which is conducive to improving flexibility of the heat exchanger.

In an embodiment of the present disclosure, the length M of the connecting section is less than or equal to 10 times of the width W of each of the plurality of flat pipes. When the length M of the connecting section is less than or equal to 10 times of the width W of each of the plurality of flat pipes, the length of the finless region of the heat exchanger can be prevent from being too long to affect heat transfer efficiency of the heat exchanger. In addition, when the length M of the connecting section is less than or equal to 10 times of the width W of each of the plurality of flat pipes, it is conducive to saving materials of the plurality of flat pipes and reducing a production cost of the heat exchanger.

In an embodiment of the present disclosure, a thickness of each of the plurality of flat pipes is defined as h, and the width W of each of the plurality of flat pipes and the thickness h of each of the plurality of flat pipes satisfy the following formula: $W/20 \leq h \leq W/5$. When the thickness h of each of the plurality of flat pipes and the width W of each of the plurality of flat pipes of each of the plurality of flat pipes satisfy the following formula: $h \geq W/20$, the plurality of flat pipes can have a better structural strength, thus preventing the plurality of flat pipes from fracture caused by a thin thickness h of each of the plurality of flat pipes in a process of bending or torsion. When the thickness h of each of the plurality of flat pipes and the width W of each of the plurality of flat pipes satisfy the following formula: $h \leq W/5$, conditions that the flat pipes are not easy to be bent and twisted caused by unduly great thickness h of each of the plurality of flat pipes can be avoided.

In some embodiments, a first torsion angle of the connecting section stacked on the outer side of the plurality of connecting sections is defined as $b_1$, a second torsion angle of the connecting section stacked on the inner side of the plurality of connecting sections is defined as $b_2$, and a third torsion angle of the connecting section stacked between the outer side and the inner side of the plurality of connecting sections is defined as $b_3$. The third torsion angle $b_3$ of the connecting section stacked between the outer side and the inner side of the plurality of connecting sections is equal to the second angle b, the first torsion angle $b_1$ of the connecting section stacked on the outer side of the plurality of connecting sections is less than the third torsion angle $b_3$ of the connecting section stacked between the outer side and the inner side of the plurality of connecting sections, and the second torsion angle $b_2$ of the connecting section stacked on the inner side of the plurality of connecting sections is defined as is less than the torsion angle $b_3$ of the connecting section stacked between the outer side and the inner side of the plurality of connecting sections. In this way, it is conducive to stacking all of the connecting sections together.

In an embodiment of the present disclosure, the plurality of flat pipes are made of stainless steel. The plurality of flat pipes made of stainless steel can be easy to process and mold. The stainless steel has good ductility, which is conducive to bending and twisting the plurality of flat pipes.

In an embodiment of the present disclosure, the plurality of fins are connected to the plurality of flat pipes by a welding process. In this way, a connection between the plurality of fins and the plurality of flat pipes can be stronger. Moreover, the welding process is mature and simple to operate, thus reducing the production cost of the heat exchanger.

In an embodiment of the present disclosure, the width W of each of the plurality of flat pipes can be greater than or equal to 10 millimeters. In this way, it facilitates processing and manufacturing of the plurality of flat pipes.

The present disclosure further provides an air conditioning device. The air conditioning device includes the heat exchanger described in any of the above embodiments.

In the heat exchanger and air conditioning device provided in the present disclosure, profile curve of the first torsion section and the second torsion section is similar to a shape of the function y=arctan(x). During a process of twisting the plurality of flat pipes, the first torsion section and the strategy section will not fracture when a slope of curve at a junction between the first torsion section and the connecting section is less than 0.6. Similarly, the second torsion section and the connecting section will not fracture when the slope of curve at a junction between the second torsion section and the connecting section is less than 0.6. It can be concluded from the function y=arctan(x), when x is $\pi/4+1/2$, the slope of curve at the point $x=\pi/4+1/2$ of the function y=arctan(x) can be approximately equal to 0.599, satisfying a condition that the slope of curve is less than 0.6. When x is $-(\pi/4+1/2)$, the slope of curve of the function y=arctan(x) at the point of $x=-(\pi/4+1/2)$ can be approximately equal to 0.599, satisfying the condition that the slope of curve is less than 0.6. Moreover, it can be concluded from a graph of the function y=arctan(x) that when x is in a range of greater than $\pi/4+1/2$, the slope of curve of the function can gradually decrease, and when x is in a range of less than $-(\pi/4+1/2)$, the slope of curve of the function can gradually decrease. Therefore, when x is not in the range of $[-(\pi/4+1/2), \pi/4+1/2]$, the slope of curve at any point of the function y=arctan(x) is less than 0.6. A length of the interval $[-(\pi/4+1/2), \pi/4+1/2]$ is $\pi/2+1$. Since the length S of the first torsion section or the length S the second torsion section is positively correlated with the length of a domain of definition the function y=arctan(x) and a width of each of the plurality of flat pipes is defined as W, the length S of the first torsion section or the length S the second torsion section S is positively correlated with the width W of each of the plurality of flat pipes. Therefore, when the length S of the first torsion section or the length S the second torsion section and the width W of each of the plurality of flat pipes 4 satisfy with the following formula: $S \geq W(\pi/2+1)$, the first torsion section and the strategy section will not fracture, the second torsion section and the strategy section will not fracture. When the length S of the first torsion section or the length S the second torsion section is slightly greater than $W(\pi/2+1)$, a problem of material waste caused by unduly long finless region can be solved

In the figures, 1 represents a first collecting pipe; 2 represents a second collecting pipe; 3 represents a fin; 4 represents a flat pipe; 41 represents a first finned region; 42 represents a second finned region; 43 represents a finless region; 431 represents a first torsion section; 432 represents a second torsion section; 433 represents a connecting section; 100 represents a heat exchanger, and 200 represents an air conditioner.

DETAILED DESCRIPTION

The technical solutions in the embodiments of the present disclosure are clearly and completely described in the following with reference to the accompanying drawings in the embodiments of the present disclosure. It is obvious that the described embodiments are only a part of the embodiments, but not all of the embodiments. All other embodiments obtained by those skilled in the art based on the embodiments of the present disclosure without making creative labor are within the scope of the present disclosure.

It should be noted that when a component is referred to as being "provided on" another element, it may be directly provided on the other element or a further element may be presented between them. When a component is referred to as being "disposed on" another element, it may be directly disposed on the other element or a further element may be presented between them. When an element is considered to be "fixed to" another element, it may be directly fixed to the other element or a further element may be presented between them.

Unless otherwise defined, all technical and scientific terms used herein have the same meaning as a skilled person in the art would understand. The terminology used in the description of the present disclosure is for the purpose of describing particular embodiments and is not intended to limit the disclosure. The term "or/and" as used herein includes any and all combinations of one or more of the associated listed items.

Figure 1:
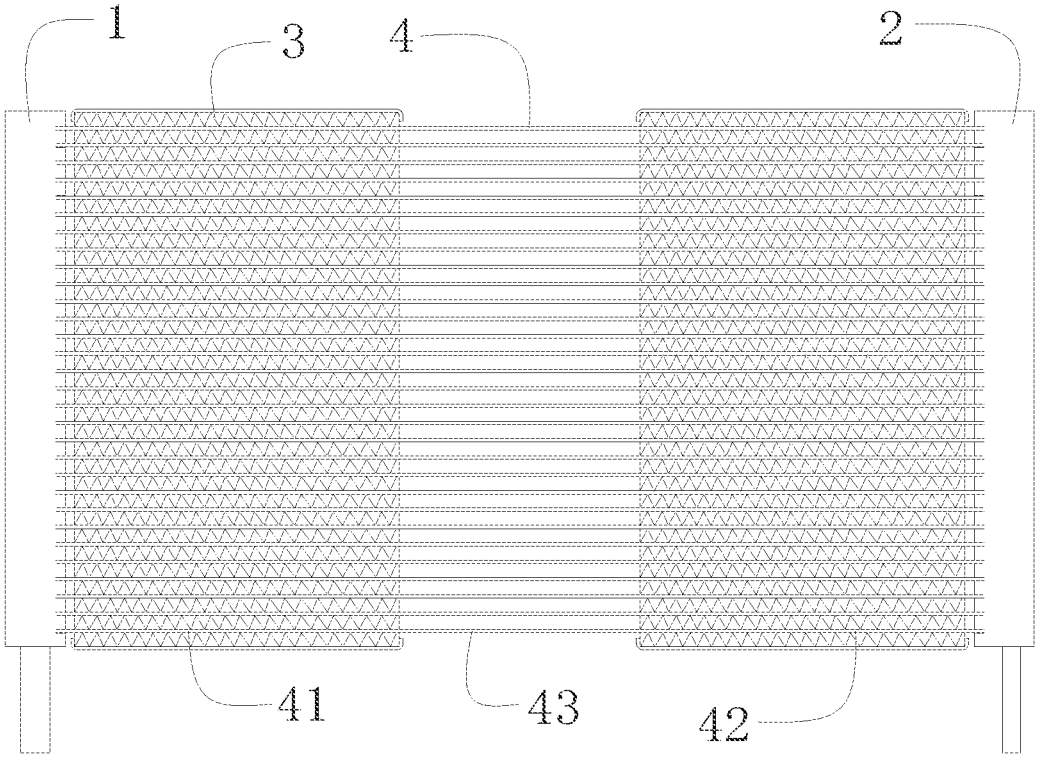
FIG. 1 is a structural schematic diagram of a heat exchanger in an embodiment of the present disclosure.
Figure 2:
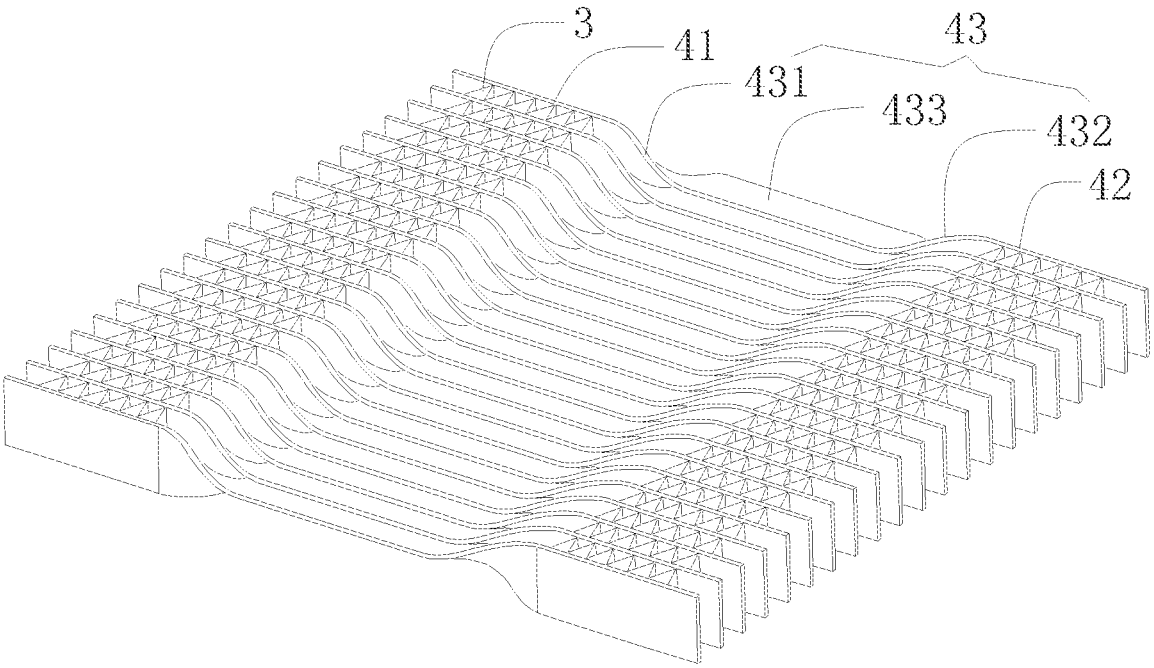
FIG. 2 is a first structural schematic diagram of a heat exchanger in another embodiment of the present disclosure.
Figure 3:
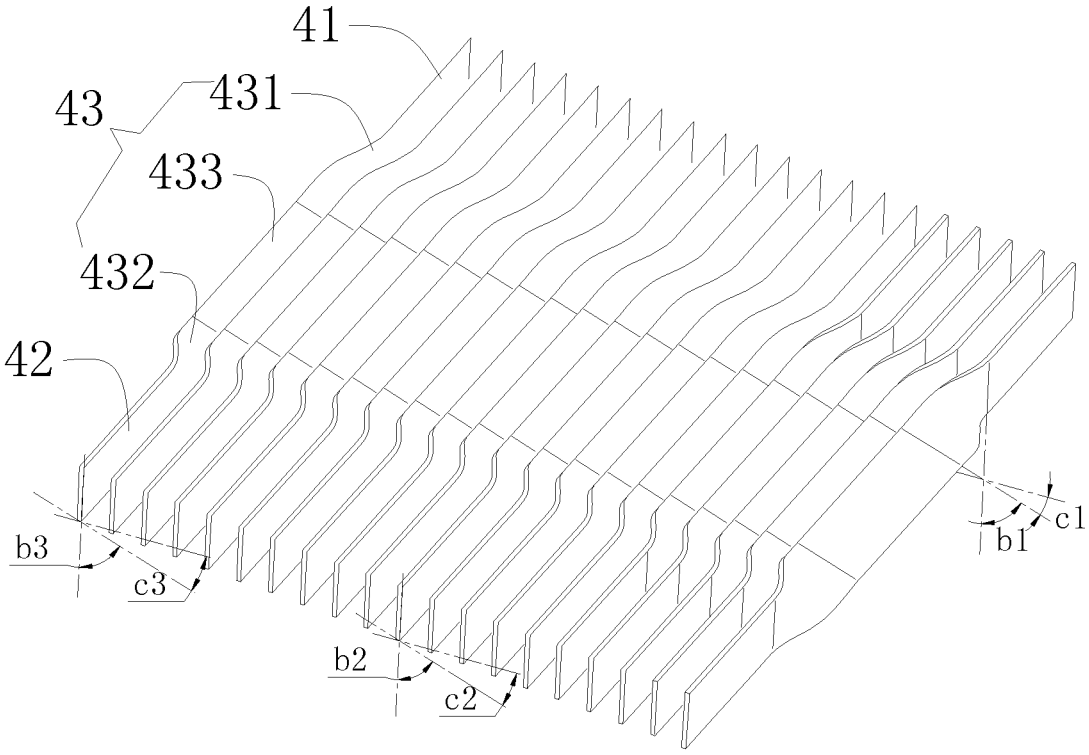
FIG. 3 is a second structural schematic diagram of a heat exchanger in another embodiment of the present disclosure.
Figure 4:
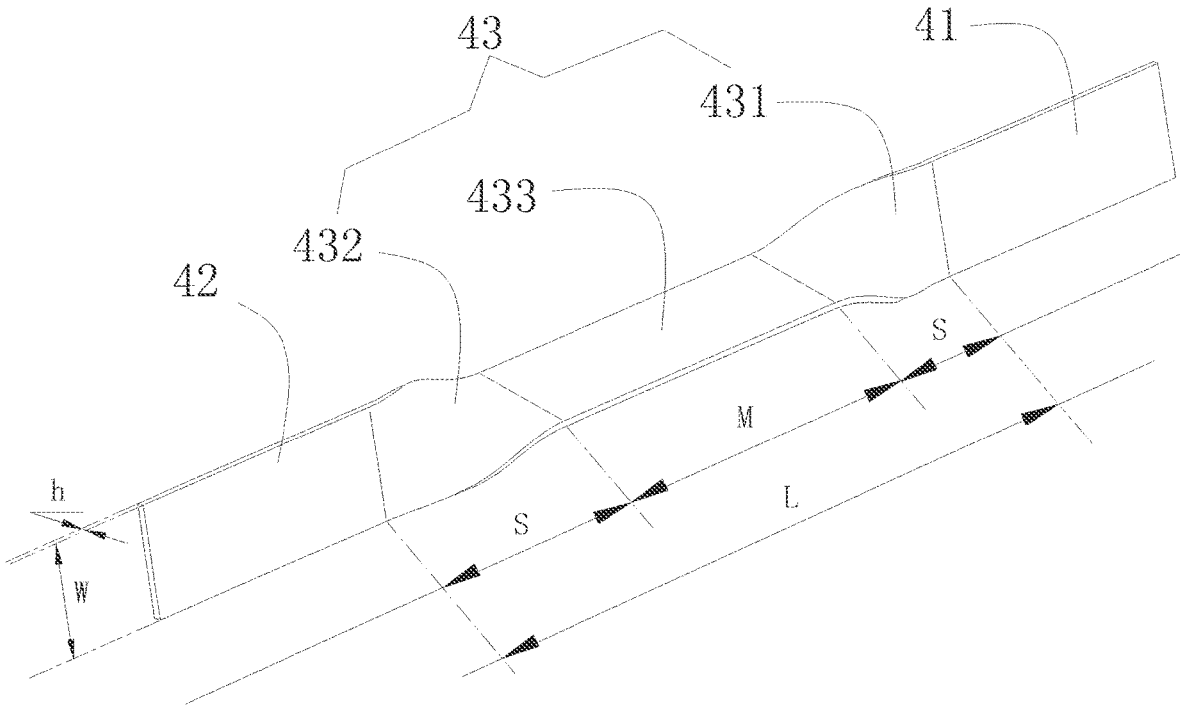
FIG. 4 is a structural schematic diagram of a flat pipe in another embodiment of the present disclosure.
Figure 5:
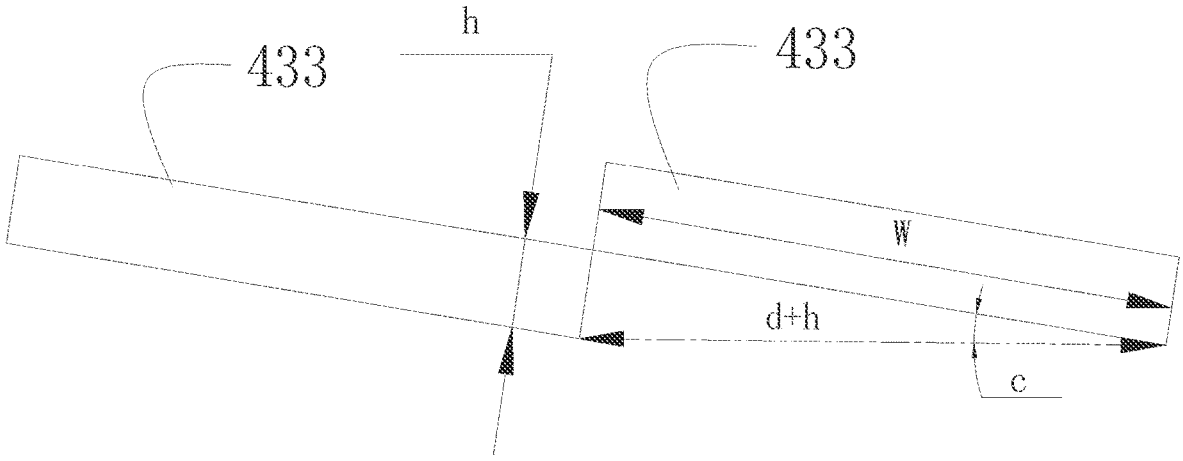
FIG. 5 is a structural schematic diagram of a heat exchanger in another embodiment of the present disclosure.
Figure 6:
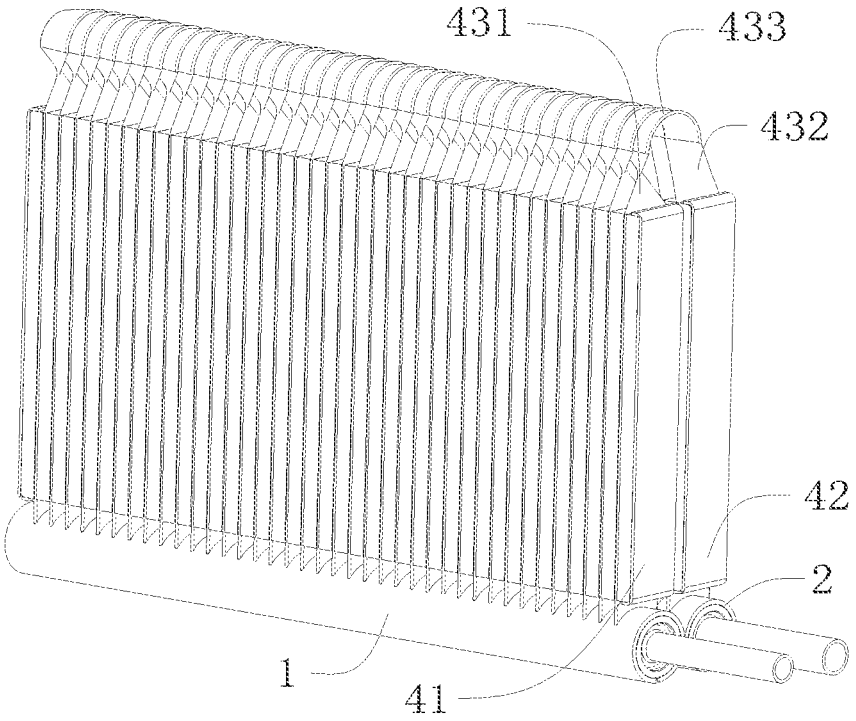
FIG. 6 is a structural schematic diagram of a heat exchanger in another embodiment of the present disclosure.
Figure 7:
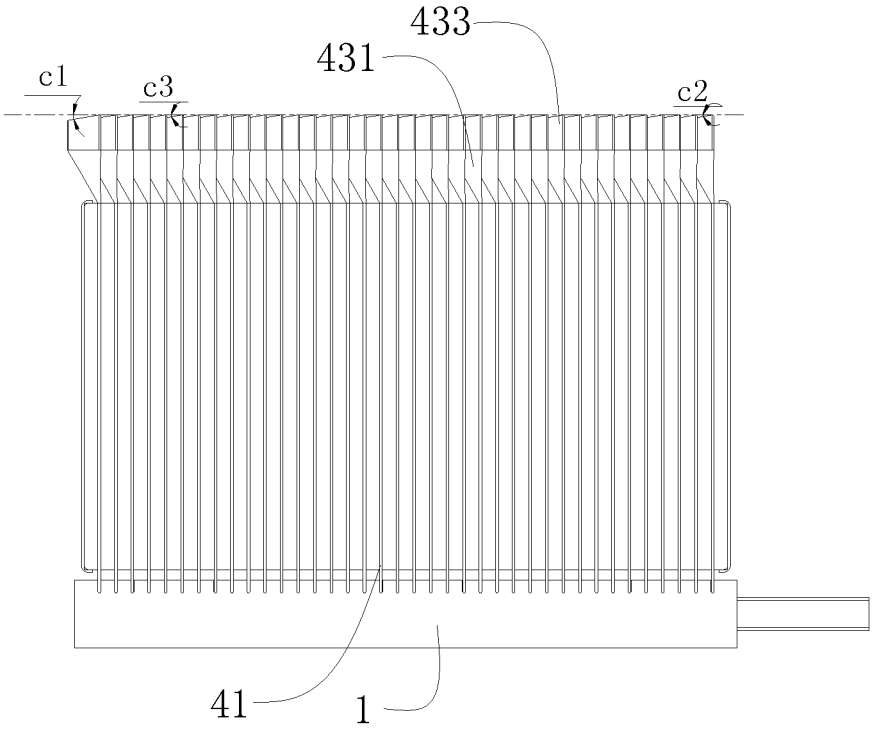
FIG. 7 is a front view of a heat exchanger in another embodiment of the present disclosure.
Figure 8:
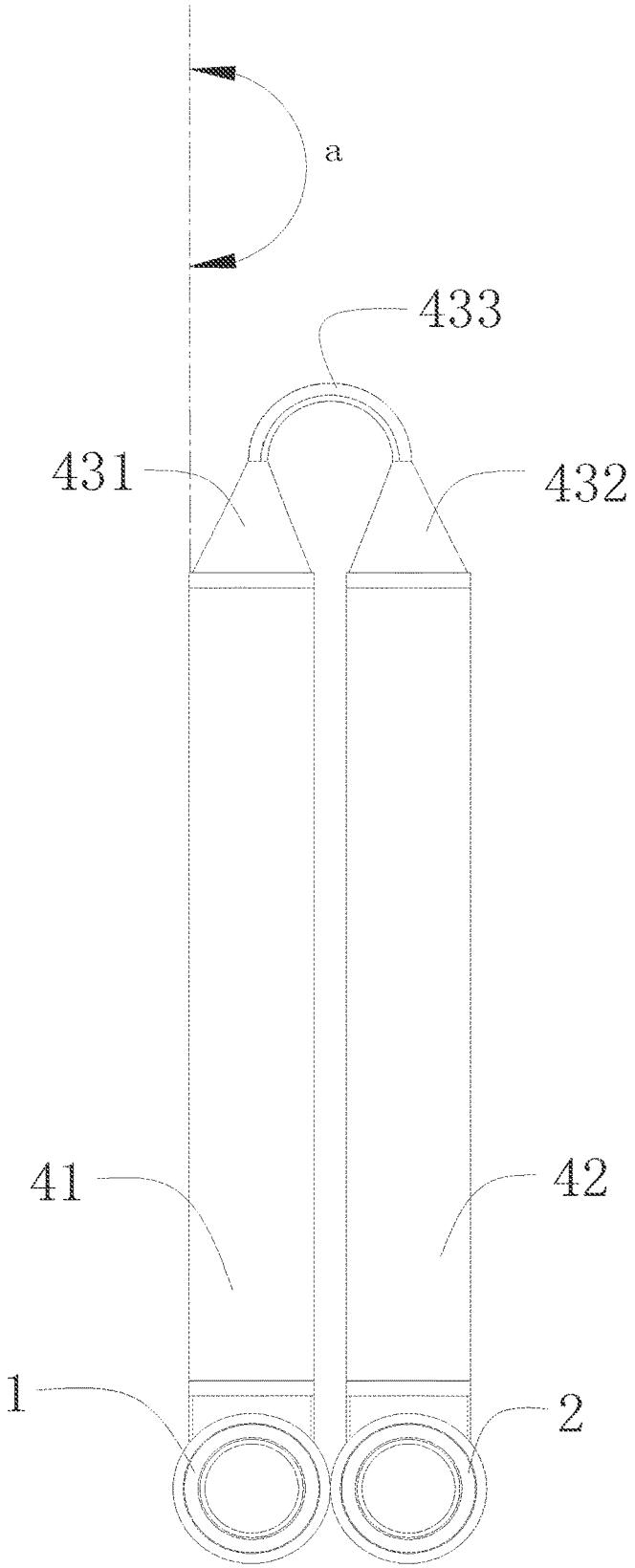
FIG. 8 is a side graph of a heat exchanger in another embodiment of the present disclosure.

Referring to FIG. 1 to FIG. 7, a flat pipe 4 of a heat exchanger in FIG. 1 is not twisted. In FIG. 2 to FIG. 5, a plurality of flat pipes 4 of the heat exchanger are twisted at a second angle, and the second angle is defined as b. In FIG. 6 to FIG. 8, the plurality of flat pipes 4 of the heat exchanger are twisted at the second angle, and the second angle is defined as b. A connecting section 433 of the heat exchanger in FIG. 6 to FIG. 8 rotates at a first angle, and the first angle is defined as a. The heat exchanger provided in the present disclosure includes a plurality of fins 3 and the plurality of flat pipes 4 arranged in parallel. Each of the plurality of flat pipes 4 includes a first finned region 41, a second finned region 42, and a finless region 43. The first finned region 41 is connected the second finned region 42 via the finless region 43. The plurality of fins 3 are provided both between adjacent two first finned regions 41 and between adjacent two second finned regions 42. The heat exchanger can further include a first collecting pipe 1 and a second collecting pipe 2. A plurality of the first finned regions 41 can be connected to the first collecting pipe 1, and a plurality of the second finned regions 42 can be connected to the second collecting pipe 2. An end of the finless region 43 connected to the first finned region 41 is twisted and defined as a first torsion section 431, and the other end of the finless region 43 connected to the second finned region 42 is twisted and defined as a second torsion section 432. A portion of the finless region 43 between the first torsion section 431 and the second torsion section 432 is defined as a connecting section 433.

Both the first torsion section 431 and the second torsion section 432 are twisted at the second angle along the same direction, so that each connecting section 433 of the plurality of flat pipes 4 is sequentially and partially stacked on another adjacent connecting section 433 along the same direction. The second angle is defined as b. The second angle is defined as b. The connecting section 433 is bent, so that the first finned region 41 is capable of rotating at the first angle relative to the second finned region 42, and the first angle is defined as a. A length of the finless region 43 is defined as L, a length of the first torsion section 431 is the same as a length of the second torsion section 432, and both the length of the first torsion section 431 and length of the second torsion section 432 are defined as S, and a length of the connecting section is defined as M, a width of each of the plurality of flat pipes is defined as W. The length L of the finless region 43, the length S of the first torsion section 431 and the length S of the second torsion section 432, the length M of the connecting section 433 and the width W of each of the plurality of flat pipes 4 satisfy following formulas: $L=2S+M$, $S \geq W(\pi/2+1)$, and the length M of the connecting section 433 is greater than or equal to the width W of each of the plurality of flat pipes 4.

Figure 9:
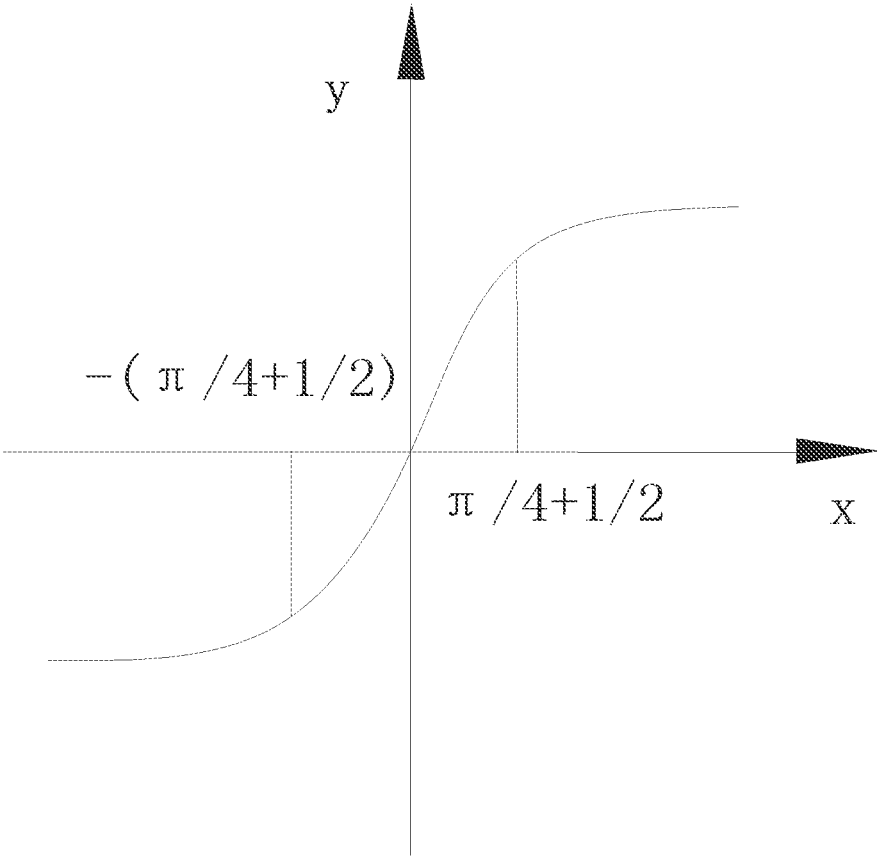
FIG. 9 is a view of a function y=arctan(x).
Figure 10:
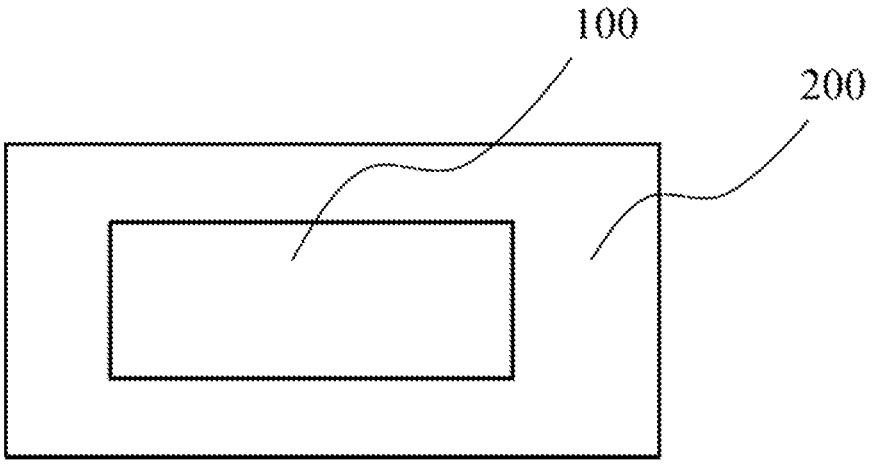
FIG. 10 is a schematic view of an air conditioner in an embodiment of the present disclosure.

Referring FIG. 9, profile curve of the first torsion section 431 and the second torsion section 432 is similar to a shape of the function $y=\arctan(x)$. During a process of twisting the plurality of flat pipes 4, the first torsion section 431 and the strategy section 433 will not fracture when a slope of curve at a junction between the first torsion section 431 and the connecting section 433 is less than 0.6. Similarly, the second torsion section 432 and the connecting section 433 will not fracture when the slope of curve at a junction between the second torsion section 432 and the connecting section 433 is less than 0.6. It can be concluded from the function $y=\arctan(x)$, when x is $\pi/4+½$, the slope of curve at the point $x=\pi/4+½$ of the function $y=\arctan(x)$ can be approximately equal to 0.599, satisfying a condition that the slope of curve is less than 0.6. When x is $-(\pi/4+½)$, the slope of curve of the function $y=\arctan(x)$ at the point of $x=-(\pi/4+½)$ can be approximately equal to 0.599, satisfying the condition that the slope of curve is less than 0.6. Moreover, it can be concluded from a graph of the function $y=\arctan(x)$ that when x is in a range of greater than $\pi/4+½$, the slope of curve of the function can gradually decrease, and when x is in a range of less than $-(\pi/4+½)$, the slope of curve of the function can gradually decrease. Therefore, when x is not in the range of $[-(\pi/4+½), \pi/4+½]$, the slope of curve at any point of the function $y=\arctan(x)$ is less than 0.6. A length of the interval $[-(\pi/4+½), \pi/4+½]$ is $\pi/2+1$. Since the length S of the first torsion section 431 or the length S the second torsion section 432 is positively correlated with the length of a domain of definition the function $y=\arctan(x)$ and a width of each of the plurality of flat pipes 4 is defined as W, the length S of the first torsion section 431 or the length S the second torsion section 432 S is positively correlated with the width W of each of the plurality of flat pipes 4. Therefore, when the length S of the first torsion section 431 or the length S the second torsion section 432 and the width W of each of the plurality of flat pipes 4 satisfy with the following formula: $S \geq W(\pi/2+1)$, the first torsion section 431 and the strategy section 433 will not fracture, the second torsion section 432 and the strategy section 433 will not fracture. When the length S of the first torsion section 431 or the length S the second torsion section 432 is slightly greater than $W(\pi/2+1)$, a problem of material waste caused by unduly long finless region can be solved.

In an embodiment, referring to FIG. 2 to FIG. 5, both the first torsion section 431 and the second torsion section 432 can be twisted at the second angle b along the same direction, and the second angle b can be in a range of greater than or equal to 50 degrees and less than 90 degrees. When the second angle b is equal to 90 degrees, adjacent two connecting sections 433 can be located in the same plane and cannot be stacked together. Therefore, when the second angle b is less than 90 degrees, it is conducive to stacking adjacent two of a plurality of connecting sections together. The connecting section 433 of the heat exchanger should be bent, so that a first angle a can be defined between the first finned region 41 and the second finned region 42. The smaller the second angle b is, the smaller an angle defined between the connecting section 433 and the first finned region 41 and the smaller an angle defined between the connecting section 433 and the second finned 42 are. The smaller the second angle b is, the greater a bending strength of the connecting section 433 along a bending direction is, that is, the more difficult it is for the connecting section 433 to bend. Therefore, when the second angle b is greater than or equal to 50 degrees, it is conducive to bending the connecting section 433, so that a first angle a can be defined between the first finned region 41 and the second finned region 42.

In an embodiment, referring to FIG. 6 to FIG. 8, the first angle a can be in a range of greater than 0 and less than or equal to 180 degrees. In this way, the connecting section 433 of the heat exchanger can be bent according to actual needs, which is conducive to improving flexibility of the heat exchanger.

Furthermore, the length M of the connecting section can be less than or equal to times of the width W of each of the plurality of flat pipes 4. In this way, since the connecting section 433 is a part of the finless region 43 of each of the plurality of flat pipes 4, that is, no fins are provided on the connecting section 433. Therefore the connecting section 433 does not have a function of heat exchange. Therefore, when the length M of the connecting section 433 is less than or equal to 10 times of the width W of each of the plurality of flat pipes 4, the length of the finless region 43 of the heat exchanger can be prevent from being too long to affect heat transfer efficiency of the heat exchanger. In addition, when the length M of the connecting section 433 is less than or equal to 10 times of the width W of each of the plurality of flat pipes 4, it is conducive to saving materials of the plurality of flat pipes 4 and reducing a production cost of the heat exchanger.

Furthermore, a thickness of each of the plurality of flat pipes 4 can be defined as h, and the width W of each of the plurality of flat pipes 4 and the thickness h of each of the plurality of flat pipes 4 satisfy the following formula: $W/20 \leq h \leq W/5$. When the thickness h of each of the plurality of flat pipes 4 and the width W of each of the plurality of flat pipes 4 of each of the plurality of flat pipes 4 satisfy the following formula: $h \geq W/20$, the plurality of flat pipes 4 can have a better structural strength, thus preventing the plurality of flat pipes 4 from fracture caused by a thin thickness h of each of the plurality of flat pipes 4 in a process of bending or torsion. When the thickness h of each of the plurality of flat pipes 4 and the width W of each of the plurality of flat pipes 4 satisfy the following formula: $h \leq W/5$, conditions that the flat pipes 4 are not easy to be bent and twisted caused by unduly great thickness h of each of the plurality of flat pipes 4 can be avoided.

In an embodiment, referring to FIG. 2 to FIG. 8, a first torsion angle of the connecting section 433 stacked on the outer side of the plurality of stacked connecting sections 433 can be defined as $b_1$, a second torsion angle of the connecting section 433 stacked on the inner side of the plurality of stacked connecting sections 433 can be defined as $b_2$, and a third torsion angle of the connecting section 433 stacked between the outer side and the inner side of the plurality of stacked connecting sections 433 is defined as $b_3$. The third torsion angle $b_3$ of the connecting section 433 stacked between the outer side and the inner side of the plurality of connecting sections 433 is equal to the second angle b, the first torsion angle $b_1$ of the connecting section 433 stacked on the outer side of the plurality of connecting sections 433 is less than the third torsion angle $b_3$ of the connecting section 433 stacked between the outer side and the inner side of the plurality of connecting sections 433, and the second torsion angle $b_2$ of the connecting section 433 stacked on the inner side of the plurality of connecting sections 433 is defined as is less than the third torsion angle $b_3$ of the connecting section 433 stacked between the outer side and the inner side of the plurality of connecting sections 433. Both the first torsion section 431 and the second torsion section 432 are twisted at the second angle b along the same direction, and the adjacent two connecting sections 433 can be stacked together along the same direction. In addition, a first tilt angle defined between the center of the connecting section and the horizontal plane can be defined as c, and the first tilt angle c and the second angle b can be in the complementary relation, that is, the second angle b and first tilt angle c can satisfy a following formula: $c+b=90°$. Therefore, the greater the second angle b is, the smaller the first tilt angle c is. A second tilt angle defined between the center of the connecting section 433 stacked on the outer side of a plurality of stacked connecting sections and the horizontal plane can be defined as $c_1$. A third tilt angle formed between the center of the connecting section 433 stacked on the inner side of the plurality of stacked connecting sections and the horizontal plane can be defined as $c_2$. A fourth tilt angle defined between the center of the connecting section 433 stacked between the outer side and the inner side of the plurality of stacked connecting sections and the horizontal plane can be defined as $c_3$. It can be concluded from the figures that only an inner surface of the connecting section 433 stacked on the outer side of the plurality of stacked connecting sections 433 is subjected to a squeezing action caused by an adjacent connecting section 433 of the plurality of stacked connecting sections 433. Therefore, the second tilt angle $c_1$ between the horizontal plane and a connecting section at an outer side of a plurality of stacked connecting sections can be relatively great under a unilateral squeezing action. Since the first torsion angle $b_1$ of the connecting section 433 stacked on the outer side of the plurality of stacked connecting sections 433 and the second tilt angle $c_1$ satisfy the following formula: $c_1+b_1=90°$, the first torsion angle $b_1$ of the connecting section 433 stacked on the outer side of the plurality of stacked connecting sections 433 can be relatively small. Similarly, only an outer surface of the connecting section 433 stacked on the inner side of the plurality of stacked connecting sections 433 is subjected to a squeezing action caused by an adjacent connecting section 433 of the plurality of stacked connecting sections 433. Therefore, the third tilt angle $c_2$ between the horizontal plane and a connecting section at an inner side of the plurality of stacked connecting sections can be relatively great under a unilateral side squeezing action. Since the second torsion angle $b_2$ and the third tilt angle $c_2$ between the horizontal plane and a connecting section at an inner side of the plurality of stacked connecting sections satisfy the following formula: $c\ 2+b_2=90°$, the second torsion angle $b_2$ of the connecting section 433 stacked on the inner side of the plurality of stacked connecting sections 433 can be relatively small. Both sides of the connecting sections 433 stacked between the outer side and the inner side of the plurality of stacked connecting sections 433 can be subjected to squeezing actions caused by adjacent two connecting sections 433. Therefore, and the second tilt angle $c_1$ between the horizontal plane and a connecting section at an outer side of a plurality of stacked connecting sections is greater than the tilt angle $c_3$ between the horizontal plane and a connecting section between the outer side and the inner side of the plurality of stacked connecting sections, and the third tilt angle $c_2$ between the horizontal plane and a connecting section at an inner side of the plurality of stacked connecting sections is greater than the fourth tilt angle $c_3$ between the horizontal plane and a connecting section between the outer side and the inner side of the plurality of stacked connecting sections. That is, the third torsion angle $b_3$ of the connecting section 433 stacked between the outer side and the inner side of the plurality of stacked connecting sections can be greater than the first torsion angle $b_1$, and the third torsion angle $b_3$ can be greater than the second torsion angle $b_2$. In conclusion, in this way, it is conducive to stacking all of the connecting sections 433 together.

Alternatively, the plurality of flat pipes 4 can be made of stainless steel. The plurality of flat pipes 4 made of stainless steel can be easy to process and mold. The stainless steel has good ductility, which is conducive to bending and twisting the plurality of flat pipes. In other embodiments, the plurality of flat pipes 4 can be made of aluminum alloy. The aluminum alloy has better thermal conductivity, so that heat transfer efficiency of the heat exchanger can be improved.

In an embodiment, the plurality of fins 3 can be connected to the plurality of flat pipes 4 by a welding process. In this way, a connection between the plurality of fins 3 and the plurality of flat pipes 4 can be stronger. Moreover, the welding process is mature, and simple to operate, thus reducing the production cost of the heat exchanger.

Furthermore, the width W of each of the plurality of flat pipes 4 can be greater than or equal to 10 millimeters. In this way, processing and manufacturing of the plurality of flat pipes 4 can be facilitated.

The present disclosure further provides an air conditioning device. The air conditioning device includes the heat exchanger described in any of the above embodiments.

The technical features of the above-mentioned embodiments can be combined arbitrarily. In order to make the description concise, not all possible combinations of the technical features are described in the embodiments. However, as long as there is no contradiction in the combination of these technical features, the combinations should be considered as in the scope of the present disclosure.

One of ordinary skill in the art should recognize that the above embodiments are used only to illustrate the present invention and are not used to limit the present invention, and that appropriate variations and improvements to the above embodiments fall within the protection scope of the present invention so long as they are made without departing from the substantial spirit of the present invention.

What is claimed is:

1. A heat exchanger, comprising a plurality of fins and a plurality of flat pipes arranged in parallel, wherein each of the plurality of flat pipes comprises a first finned region, a second finned region, and a finless region, the first finned region is connected to the second finned region via the finless region, the plurality of fins are provided both between adjacent two first finned regions and between adjacent two second finned regions, an end of the finless region connected to the first finned region is twisted and defined as a first torsion section, the other end of the finless region connected to the second finned region is twisted and defined as a second torsion section, and a portion of the finless region between the first torsion section and the second torsion section is defined as a connecting section, both the first torsion section and the second torsion section are twisted at a second angle along the same direction, so that each connecting section of the plurality of flat pipes is sequentially and partially stacked on an adjacent connecting section along the same direction, and the second angle is defined as b, a length of the finless region is defined as L, a length of the first torsion section is the same as a length of the second torsion section, and both the length of the first torsion section and length of the second torsion section are defined as S, a length of the connecting section is defined as M, a width of each of the plurality of flat pipes is defined as W, and the length L of the finless region, the length S of the first torsion section and the length S of the second torsion section, the length M of the connecting section and the width W of each of the plurality of flat pipes satisfy following formulas: $L=2S+M$, $S \geq W(\pi/2+1)$, and the length M of the connecting section is greater than or equal to the width W of each of the plurality of flat pipes;

a first torsion angle of the connecting section stacked on the outer side of the plurality of connecting sections is defined as $b_1$, a second torsion angle of the connecting section stacked on the inner side of the plurality of connecting sections is defined as $b_2$, a third torsion angle of the connecting section stacked between the outer side and the inner side of the plurality of connecting sections is defined as $b_3$, and the third torsion angle $b_3$ of the connecting section stacked between the outer side and the inner side of the plurality of connecting sections is equal to the second angle b, the first torsion angle $b_1$ of the connecting section stacked on the outer side of the plurality of connecting sections is less than the third torsion angle $b_3$ of the connecting section stacked between the outer side and the inner side of the plurality of connecting sections, and the second torsion angle $b_2$ of the connecting section stacked on the inner side of the plurality of connecting sections is defined as is less than the third torsion angle $b_3$ of the connecting section stacked between the outer side and the inner side of the plurality of connecting sections.

2. The heat exchanger of claim 1, wherein the second angle b is in a range of greater than or equal to 50 degrees and less than 90 degrees.

3. The heat exchanger of claim 1, wherein the connecting section bends along a length direction of the plurality of flat pipes, so that a first angle a is defined between the first finned region and the second finned region, and the first angle a is in a range of greater than 0 and less than or equal to 180 degrees.

4. The heat exchanger of claim 1, wherein the length M of the connecting section is in a range of less than or equal to 10 times of the width W of each of the plurality of flat pipes.

5. The heat exchanger of claim 1, wherein a thickness of each of the plurality of flat pipes is defined as h, and the width W of each of the plurality of flat pipes and the thickness h of each of the plurality of flat pipes satisfy a following formula: $W/20 \leq h \leq W/5$.

6. The heat exchanger of claim 1, wherein the plurality of flat pipes are made of stainless steel.

7. The heat exchanger of claim 1, wherein the plurality of fins are connected to the plurality of flat pipes by a welding process.

8. The heat exchanger of claim 1, wherein the width W of each of the plurality of flat pipes is in a range of greater than or equal to 10 millimeters.

9. An air conditioning device, comprising the heat exchanger of claim 1.

* * * * *